US006314610B1

(12) United States Patent
Miller et al.

(10) Patent No.: US 6,314,610 B1
(45) **Date of Patent: *Nov. 13, 2001**

(54) VACUUM CLEANER BAG HOUSING ASSEMBLY

(75) Inventors: Daniel R. Miller, North Canton; David J. Boles, Barberton; Lynn A. Frederick, Ravenna; Douglass A. King, North Canton; Raymond L. Lawter, Millersburg, all of OH (US)

(73) Assignee: The Hoover Company, North Canton, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/298,534

(22) Filed: Apr. 23, 1999

(51) Int. Cl.[7] ..... A47L 9/14

(52) U.S. Cl. ..... 15/347; 15/351; 55/359; 55/DIG. 3

(58) Field of Search ..... 15/347, 350, 351, 15/352, 327.2; 55/DIG. 3, 359

(56) References Cited

U.S. PATENT DOCUMENTS

| | | | | |
|---|---|---|---|---|
| D. 198,443 | | 6/1964 | Mango et al. . | |
| D. 328,165 | | 7/1992 | Ferrari et al. . | |
| 1,007,555 | | 10/1911 | Gober . | |
| 2,633,596 | | 4/1953 | Turner et al. . | |
| 2,784,800 | * | 3/1957 | Segesman | 15/347 X |
| 3,408,438 | | 10/1968 | Staunton . | |
| 3,491,519 | | 1/1970 | Ettridge . | |
| 3,675,268 | * | 7/1972 | Nordeen | 15/350 |
| 3,879,797 | | 4/1975 | Principe et al. . | |
| 4,130,622 | | 12/1978 | Pawlak . | |
| 4,216,184 | | 8/1980 | Thomas . | |
| 4,670,937 | | 6/1987 | Sumerau et al. . | |
| 4,709,443 | | 12/1987 | Bigley . | |
| 4,749,386 | | 6/1988 | Strohmeyer et al. . | |
| 4,961,765 | * | 10/1990 | Guhne et al. | 15/351 X |
| 5,289,612 | * | 3/1994 | Glenn | 15/351 X |
| 5,390,392 | | 2/1995 | Thomas et al. . | |
| 5,593,706 | | 1/1997 | Specht . | |
| 5,661,944 | | 9/1997 | Specht . | |
| 5,725,427 | | 3/1998 | Koerber . | |
| 5,725,623 | * | 3/1998 | Bowerman et al. | 65/DIG. 3 |
| 5,774,966 | | 7/1998 | Yates . | |
| 5,961,676 | * | 11/1999 | King et al. | 15/347 X |

FOREIGN PATENT DOCUMENTS

| | | | |
|---|---|---|---|
| 028 741 | | 11/1979 | (EP) . |
| 0058 253 A1 | | 9/1993 | (EP) . |
| 2098056 A | | 11/1982 | (GB) . |
| 2265096 A | | 9/1993 | (GB) . |
| 528778 | * | 11/1940 | (GB) | 15/350 |

* cited by examiner

*Primary Examiner*—Chris K. Moore
(74) *Attorney, Agent, or Firm*—A. Burgess Lowe; Thomas R. Kingsbury

(57) ABSTRACT

A bag housing assembly for a vacuum cleaner includes a rear bag housing which forms a bag cavity and a bag door which releasably attaches to the rear bag housing for enclosing the bag cavity. One of the rear bag housing and bag door is formed of a semi-rigid flexible fabric material which is permeable to air and which is sufficiently rigid to retain a molded shape. The flexible fabric material is attached to a rigid frame member which allows the bag door to releasably attach to the rear bag housing.

21 Claims, 10 Drawing Sheets

FIG.-8
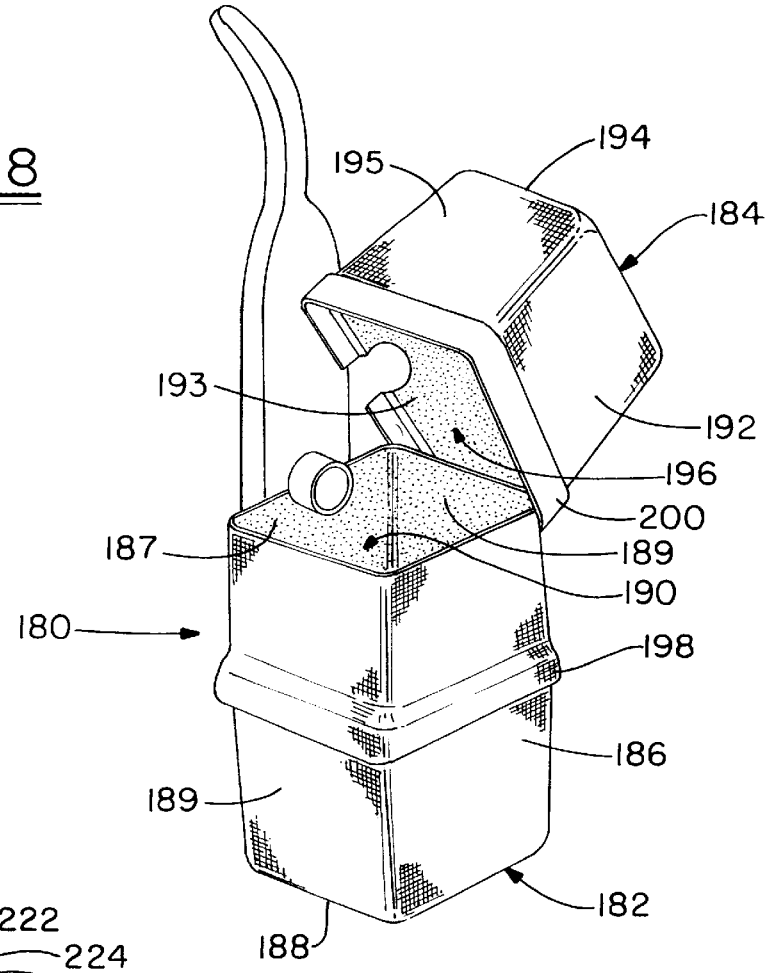
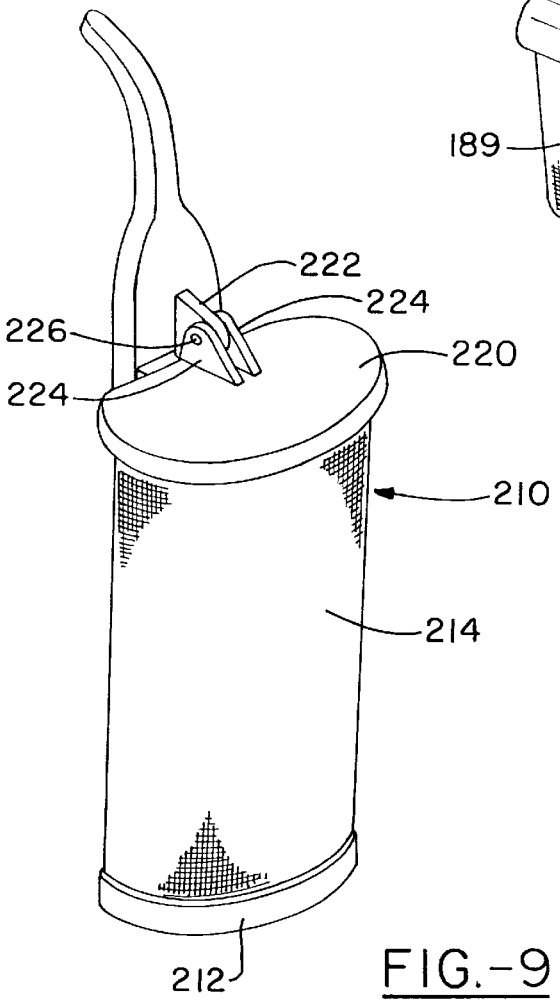
FIG.-9
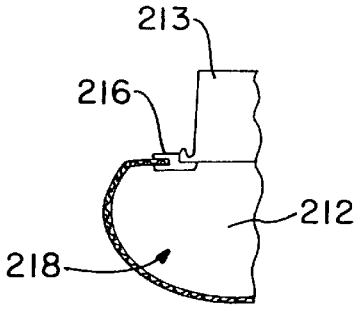
FIG.-9A

VACUUM CLEANER BAG HOUSING ASSEMBLY

BACKGROUND OF THE INVENTION

1. Technical Field

The invention relates to vacuum cleaners. Particularly, the invention relates to a vacuum cleaner bag housing assembly. Even more particularly, the invention relates to a bag housing assembly having a rear bag housing and a bag door, one or both of which is at least partially formed of a semi-rigid flexible fabric material.

2. Background Information

Conventional upright vacuum cleaners typically include a foot portion and an upper handle portion pivotally connected to the foot portion. The foot includes an agitator for agitating or loosening dirt and debris from the floor surface, and a motor-fan assembly which creates a suction for drawing the dirt and debris into the vacuum cleaner through a nozzle. The upper handle portion supports a bag housing assembly and includes a hand grip which is used to manipulate the vacuum cleaner over the floor surface. The bag housing assembly houses a vacuum cleaner filter bag which fluidly communicates with the nozzle to receive and filter the dirt-laden air and emit clean exhaust air.

Various types of bag housing assemblies have been used to house and mount the filter bag. The most popular types of bag housing assemblies are referred to as "soft bag" housings and "hard bag" housings. Soft bag housings are usually manufactured from a fabric, such as a non-woven polyester or a porous vinyl material, to allow the clean exhaust air to flow therethrough. The filter bag is accessible through a zippered opening formed in the soft bag which allows the user to remove and replace the filter bag. These soft bag housing assemblies are lightweight which reduces the total weight of the vacuum cleaner, and are formed from a deformable non-scuffing material which will not damage furniture in the event the vacuum cleaner accidentally comes into contact therewith. Further, the air permeable soft bags provide an additional layer of filter material which is capable of filtering some particles which may escape the filter bag.

Hard bag housings are typically formed from a rigid plastic such as ABS or polystyrene and include a rear bag housing which forms a bag cavity, and a hard bag door which encloses the bag cavity. The hard bag door releasably latches to the rear bag housing allowing the user to remove and replace the filter bag. These hard bag housings provide easy access to the filter bag by merely unlatching and removing the bag housing door, and provide an aesthetically pleasing appearance to the vacuum cleaner.

Although these bag housing assemblies are adequate for the purpose for which they are intended, the need exists for an improved bag housing assembly which combines the lightweight, soft and non-scuffing characteristics of a soft bag housing with the easy filter bag access and aesthetically pleasing appearance of a hard bag housing.

SUMMARY OF THE INVENTION

Objectives of the present invention include providing an improved bag housing assembly which is formed of a material which is soft and deformable yet sufficiently rigid to retain a molded shape.

Another objective is to provide such an assembly which is formed of a non-scuffing material which will not damage furniture when contact is made therewith.

A further objective is to provide such an assembly which is at least partially formed of a lightweight fabric which reduces the total weight of the vacuum cleaner.

A still further objective is to provide such an assembly which provides easy access for removal and replacement of the filter bag.

A further objective is to provide such an assembly which provides an additional layer of filtering material to the exhaust system of the vacuum cleaner.

Another objective is to provide such an assembly in which the semi-rigid flexible fabric material is fastened to a rigid frame member to facilitate the attachment of the bag door to the rear bag housing.

These and other objectives will be readily apparent from the following description taken in conjunction with the accompanying drawings.

In carrying out the invention in one form thereof, these objectives and advantages are obtained by providing a vacuum cleaner bag housing assembly movable between open and closed positions, said bag housing assembly including a bag housing which forms a bag cavity for receiving a vacuum cleaner filter bag; a bag door attached to the bag housing to enclose the bag cavity; and wherein one of the bag housing and bag door is formed of a semi-rigid flexible material which is permeable to air and sufficiently rigid to retain a molded shape.

BRIEF DESCRIPTION OF DRAWINGS

The preferred embodiments of the invention, illustrative of the best modes in which applicants have contemplated applying the principles are set forth in the following description and are shown in the drawings and are particularly and distinctly pointed out and set forth in the appended claims.

FIG. 8 is a perspective view of a sixth embodiment of the bag housing assembly shown in an open position;

FIG. 9 is a seventh embodiment of the bag housing assembly;

FIG. 9A is a fragmentary sectional view of the bag housing assembly of FIG. 9;

Similar numerals refer to similar parts throughout the drawings.

DESCRIPTION OF THE PREFERRED EMBODIMENTS

Figure 1:
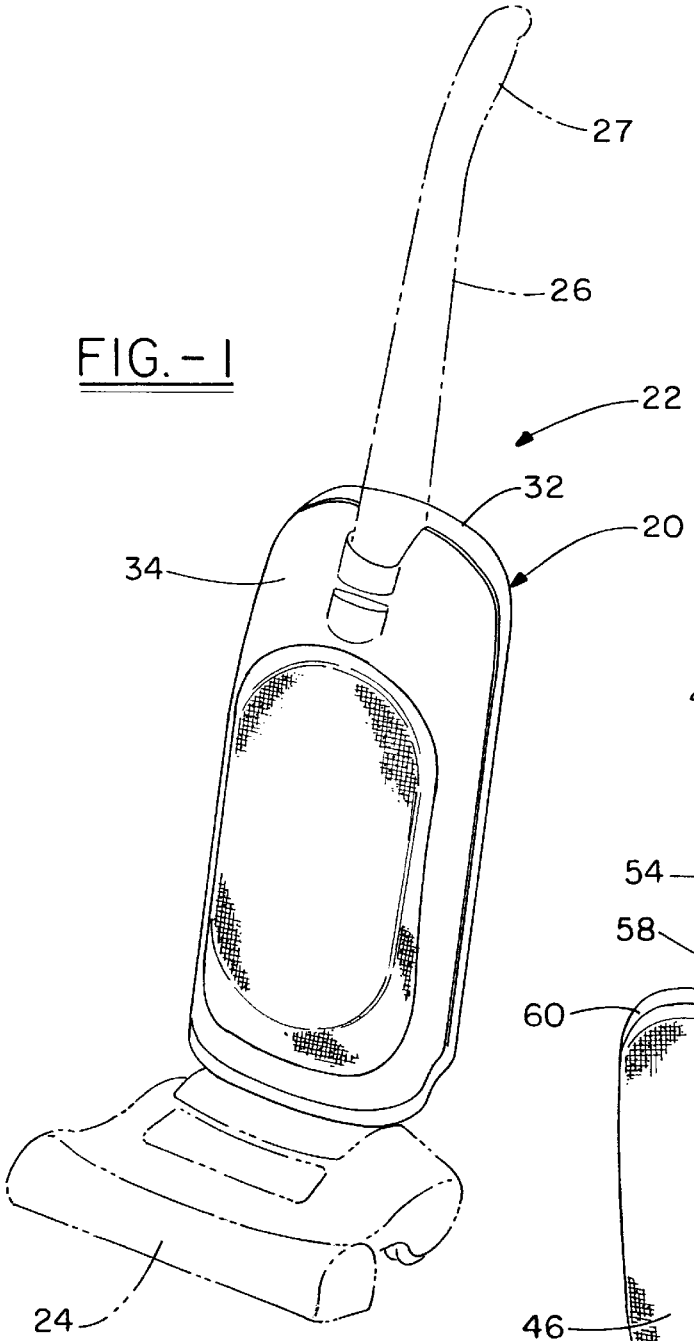
FIG. 1 is a perspective view of a first embodiment of the vacuum cleaner bag housing assembly of the present invention shown on a vacuum cleaner with the upper handle portion and foot of the vacuum cleaner shown in dot-dash lines.
Figure 1A:
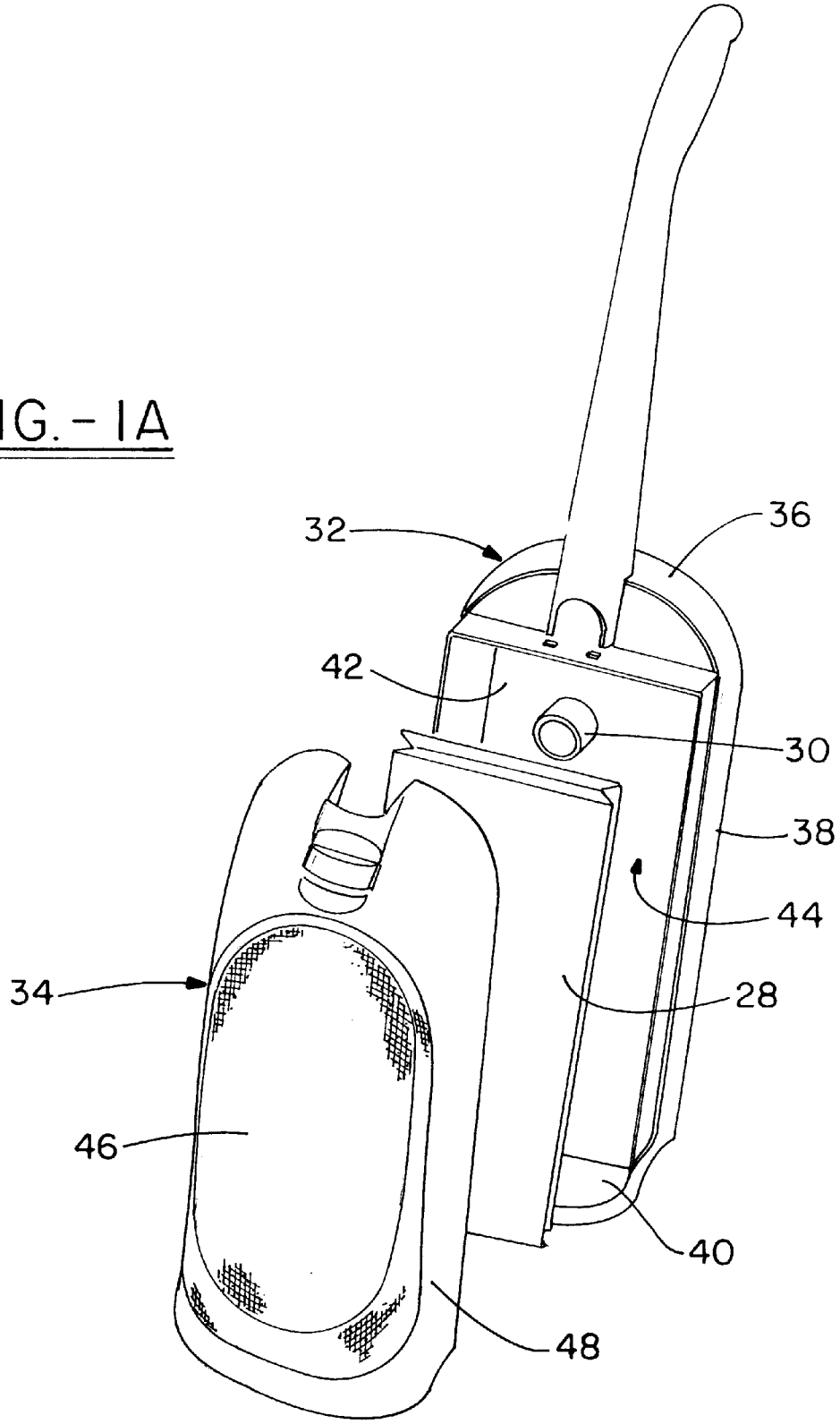
FIG. 1A is an exploded perspective view of the upper handle portion and bag housing assembly of FIG. 1.

The vacuum cleaner bag housing assembly of the present invention is indicated at 20 in FIG. 1 and is shown attached to a vacuum cleaner 22. In addition to bag housing assembly 20, vacuum cleaner 22 includes a foot or nozzle 24 and an upper handle portion 26, both of which are shown in dot-dash lines. Upper handle portion 26 supports bag housing assembly 20 and includes a hand grip 27 for manipulating vacuum cleaner 22 over a floor surface. Nozzle 24 (FIG. 1) is as conventionally known in the art and includes an agitator (not shown) which agitates or loosens dirt and debris from the floor surface, and a motor-fan assembly (not shown) which provides a suction for drawing dirt and debris laden air into a vacuum cleaner filter bag 28 (FIG. 1A). Filter bag 28 is supported by a fill tube 30 formed in upper handle portion 26. Fill tube 30 provides fluid communication between nozzle 24 and filter bag 28. Filter bag 28 receives the dust and dirt laden air from nozzle 24 via fill tube 30, filters the dirty air and emits clean exhaust air.

Bag housing assembly 20 generally includes a rear bag housing 32 and a bag door 34. Rear bag housing 32 includes a top wall 36, a pair of side walls 38, a bottom wall 40 and a rear wall 42. Walls 36, 38, 40 and 42 form a bag cavity 44 which houses filter bag 28 and which is enclosed by bag door 34. In the preferred embodiment, rear housing bag portion 32 is formed from a rigid plastic material, such as ABS.

Figure 2:
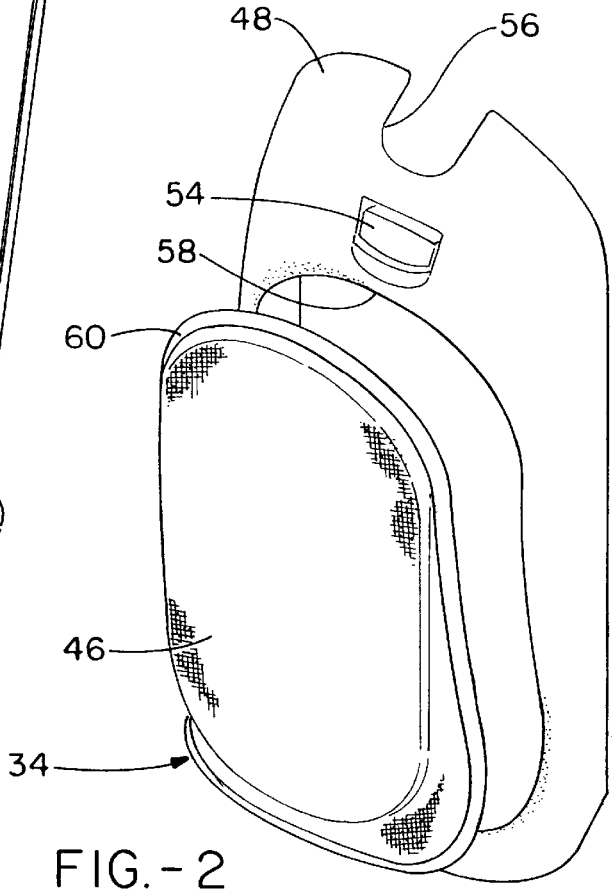
FIG. 2 is an exploded perspective view of the bag housing door of the bag housing assembly of FIG. 1.
Figure 3:
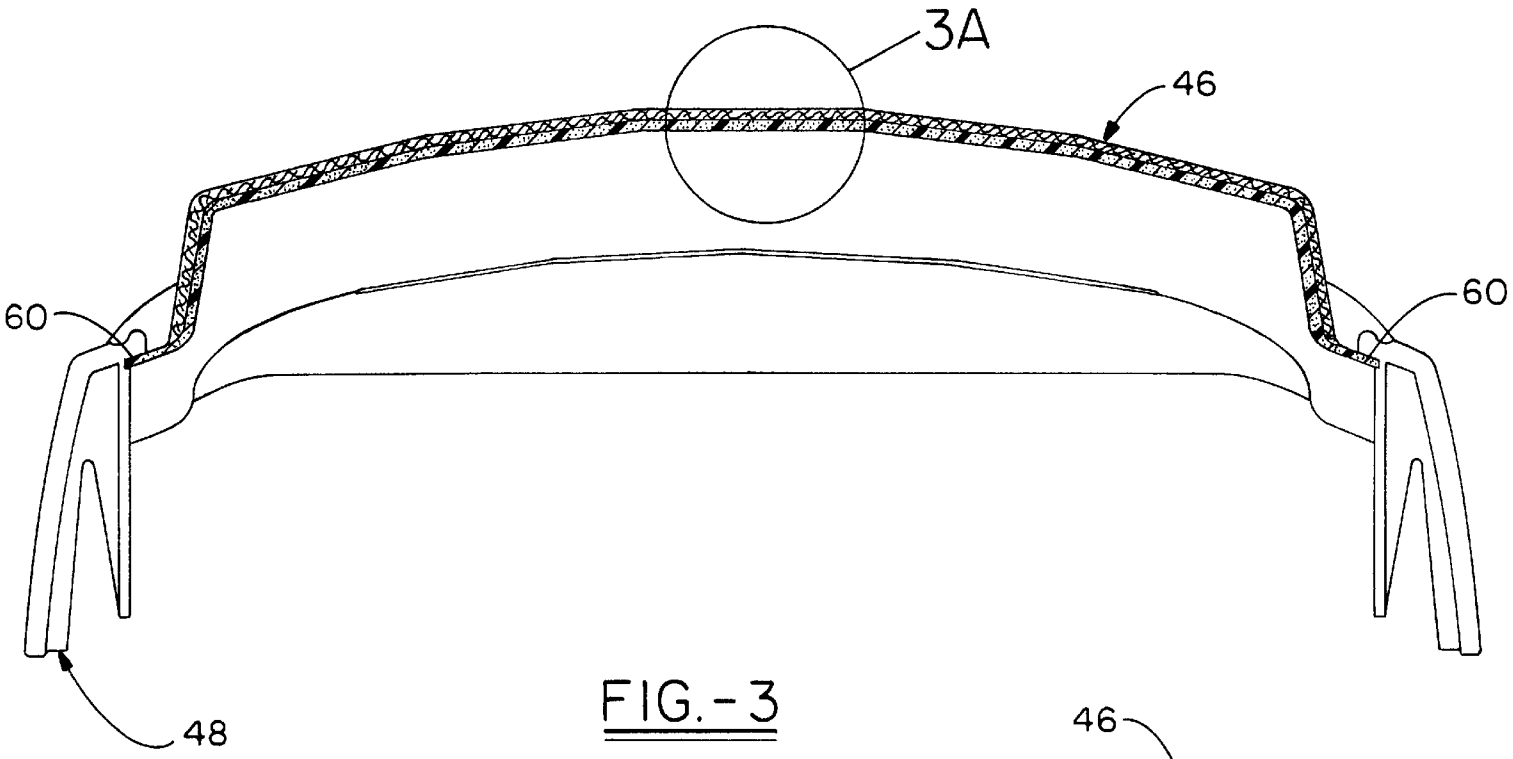
FIG. 3 is a sectional view of the bag housing door of FIG. 1.
Figure 3A:
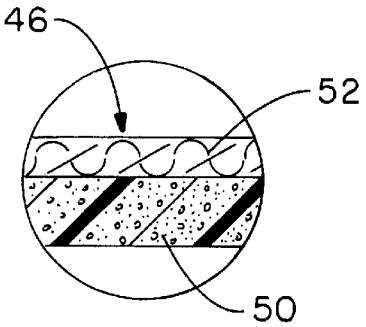
FIG. 3A is an enlarged sectional of the encircled portion of FIG. 3.

In accordance with the main feature of the invention, bag door 34 includes a center fabric panel 46 and a rigid frame member 48 fastened to an outer edge 60 of fabric panel 46 (FIGS. 2 and 3). Fabric panel 46 is formed of a semi-rigid flexible fabric material which is soft and deformable yet sufficiently rigid to retain a molded shape. In the preferred embodiment, fabric panel 46 includes two layers of material with the inner layer being a non-woven bi-component polyester 50 (FIG. 3A) and the outer layer being a decorative layer of a stretchable polyester 52 which is glued or otherwise attached to bi-component polyester layer 50. Bi-component polyester material 50 and stretchable polyester material 52 are permeable to air to allow the exhaust air emitted by filter bag 28 to pass therethrough. The materials also provide an additional layer of filtration to further filter the exhaust air from filter bag 28 before the exhaust air exits bag cavity 44 and flows into the atmosphere. Bi-component layer 50 and stretchable layer 52 provide a soft non-scuffing surface to bag door 34 which will not damage furniture when contact is made therewith. Further, polyester layers 50 and 52 are lightweight which reduces the total weight of vacuum cleaner 22 as compared to vacuum cleaners having a solid plastic bag door, as is currently known in the art.

Frame member 48 is preferably formed of a rigid non-permeable plastic, such as ABS, and is formed with a generally oval-shaped opening 58 (FIG. 2) which is complementary in shape to and receives fabric panel 46. Frame member 48 provides a rigid structure which facilitates the attachment of bag door 34 to rear bag housing 32 giving bag housing assembly 20 the aesthetically pleasing appearance of a hard bag housing with the lightweight and non-scuffing features of a soft bag housing.

Frame member 48 includes a latch 54 which allows frame member 48 and thus bag door 34 to be releasably secured to rear bag housing 32. Latch 54 allows bag door 34 to be easily removed from rear bag housing 32 thus providing easy access to bag cavity 44 for the removal and replacement of filter bag 28. Frame member 48 is formed with a cutout area 56 which receives hand grip 27 of upper handle portion 26 when bag door 34 is secured to rear bag housing 32.

In the preferred embodiment of FIG. 3, rigid frame member 48 is molded directly onto a peripheral edge 60 of fabric panel 46. In such a molding process, panel 46 is sandwiched between upper and lower halves of a molding machine with peripheral edge 60 of the panel being compressed between the mold halves to prevent the thermoplastic ABS from overflowing onto the visible center of the panel. Using high pressure injection molding, the melted ABS flows into the mold halves and is injection molded to the perimeter of fabric panel 46. The hot thermoplastic ABS is embedded into the fibers of bi-component polyester layer 50 and stretchable polyester layer 52 to secure rigid plastic frame member 48 thereto.

Figure 12A:
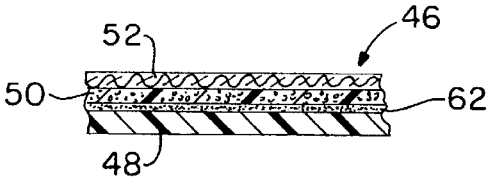
FIG. 12A is a fragmentary sectional view showing a fabric panel of the bag door fastened to a frame member with an adhesive.

Alternate methods of fastening fabric panel 46 to frame member 48 are shown in FIGS. 12A–12G. A first alternate method is shown in FIG. 12A and includes applying a layer of an adhesive 62, such as a hot-melt glue, between bi-component polyester layer 50 of the fabric panel and frame member 48. Adhesive 62 is shown in FIG. 12A bonding the outer surface of frame member 48 to the inner surface of fabric panel 46, but it is understood that the adhesive could also be applied between the outer surface of the fabric panel and the inner surface of the frame member without affecting the concept of the invention.

Figure 12B:
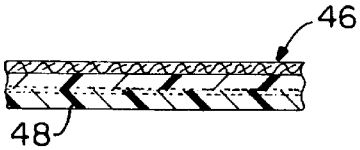
FIG. 12B is a fragmentary sectional view similar to FIG. 12A showing the fabric panel ultrasonically welded to the frame member.

A second alternate method is shown in FIG. 12B and includes ultrasonically welding frame member 48 to fabric panel 46.

Figure 12C:
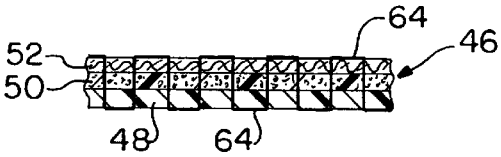
FIG. 12C is a fragmentary sectional view similar to FIG. 12B showing the fabric panel sewn to the frame member.

A third alternate method is shown in FIG. 12C and includes sewing fabric panel 46 to frame member 48 with a thread 64. Thread 64 may be formed of plastic, fiber or any other type of suitable material.

Figure 12D:
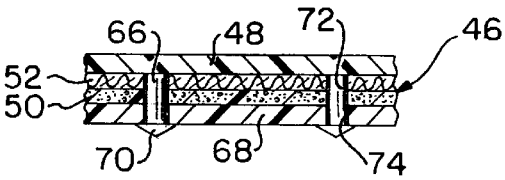
FIG. 12D is a fragmentary sectional view similar to FIG. 12C showing the fabric panel fastened to the frame member by a retaining member which snap fits with the frame member.

A fourth alternate method is shown in FIG. 12D and includes a plurality of posts 66 extending outwardly from a rear surface of frame member 48 and a retaining member 68. Posts 66 are formed integrally with frame member 48 with each post having an enlarged barbed head 70. Fabric panel 46 and retaining member 68 are formed with a plurality of holes 72 and 74, respectively, which correspond in number and location to posts 66. Holes 72 and 74 are slightly smaller in diameter to the barbed portion of heads 70 wherein heads 70 snap-fit with holes 72 and 74 to hold fabric panel 46 between retaining member 68 and frame member 48.

Figure 12E:
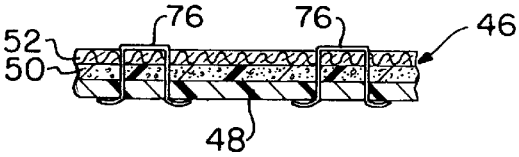
FIG. 12E is a view similar to FIG. 12D showing the fabric panel stapled to the frame member.

A fifth alternate method is shown in FIG. 12E and includes stapling fabric panel 46 to frame member 48 with a plurality of staples 76. Staples 76 are inserted through fabric panel 46 with the curved ends thereof secured to frame member 48. Frame member 48 provides a rigid surface which prevents the curved ends of the staples from pulling through the soft fabric material of panel 46.

Figure 12G:
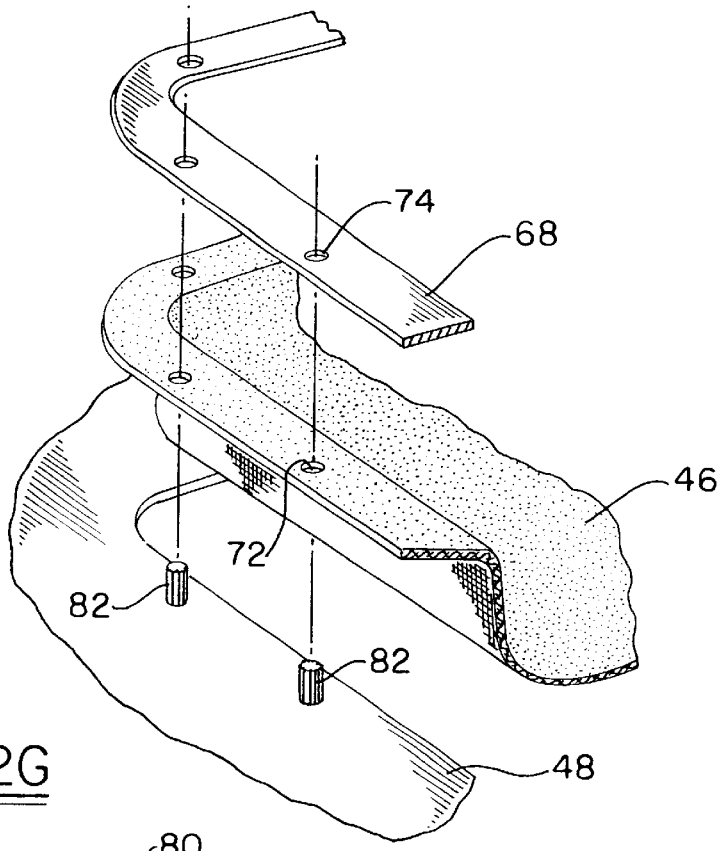
FIG. 12G is an exploded perspective view showing a retaining member which frictionally fastens to the frame member to hold the fabric panel therebetween.
Figure 12F:
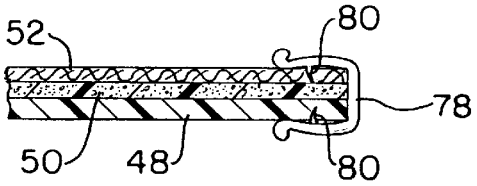
FIG. 12F is a view similar to FIG. 12E showing the fabric panel being fastened to the frame member with a clip.

A sixth alternate method is shown in FIG. 12F and includes a plurality of generally U-shaped clips 78 which extend over the peripheral edge of fabric panel 46 and frame member 48. Each clip 78 includes a pair of barbs 80 which extend towards the closed end of the clip and are embedded into the bag door to prevent the clip from sliding from its engagement with bag door 34.

A seventh alternate method is shown in FIG. 12G and is generally similar to that of FIG. 12D with the exception of posts 66. Frame member 48 of FIG. 12G includes splined pins 82 which friction or press fit with holes 74 of retaining member 68 to sandwich fabric panel 46 between retaining member 68 and frame member 48.

It is understood that methods of fastening fabric panel 46 to frame member 48 other than those discussed above exist. For example, panel 46 and frame member 48 could be fastened together using screws or rivets. However, in the preferred embodiment, frame member 48 is molded directly to the edge of fabric panel 46.

Figure 4:
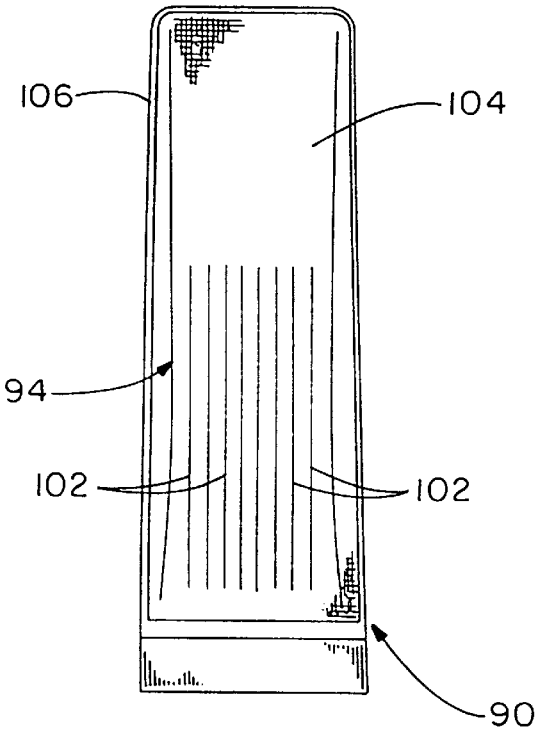
FIG. 4 is a front elevational view of a second embodiment of the bag housing assembly.
Figure 4A:
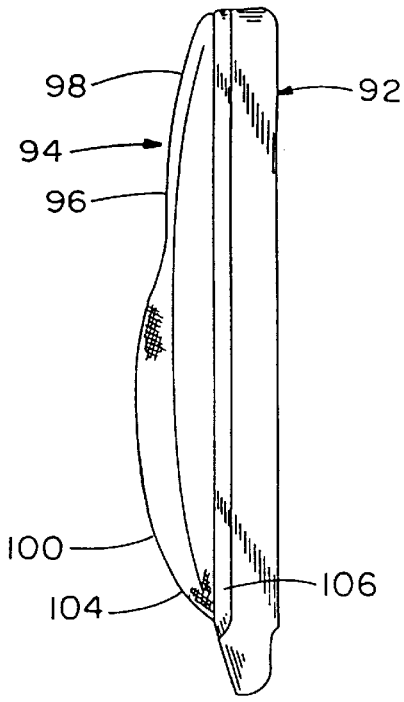
FIG. 4A is a side elevational view of the bag housing assembly of FIG. 4.

A second embodiment of the vacuum cleaner bag housing assembly of the present invention is shown in FIGS. 4 and 4A and is indicated generally at 90. Bag housing assembly 90 includes a generally rectangular shaped rear bag housing 92 (FIG. 4A) and a bag door 94. Rear bag housing 92 is formed of a rigid plastic, such as ABS, and is generally similar to rear bag housing 32 of bag housing assembly 20. Bag door 94 is complementary in shape to rear bag housing 92 and includes an outer surface 96 which has an upper portion 98 and a rounded, protruding lower portion 100. Lower portion 100 of outer surface 96 is formed with a plurality of vertically extending indentations 102 (FIG. 4) which form inwardly extending ribs on the inner surface of bag door 94. The ribs of the inner surface prevent sealing of the filter bag against bag door 94 which would reduce the exhaust air flow from the filter bag, thus reducing the performance of vacuum cleaner 22.

Bag door 94 is similar to bag door 34 in that bag door 94 includes a fabric panel 104 connected to a rigid plastic frame member 106. However, unlike the relatively small oval-shaped panel of bag door 34, fabric panel 104 of bag door 94 encloses substantially the entire front of bag cavity 44 of rear bag housing 92. Frame member 106 of bag door 94 is formed as a thin strip of plastic and is fastened to the peripheral edge of fabric panel 104 by any of the fastening methods discussed above.

Figure 5:
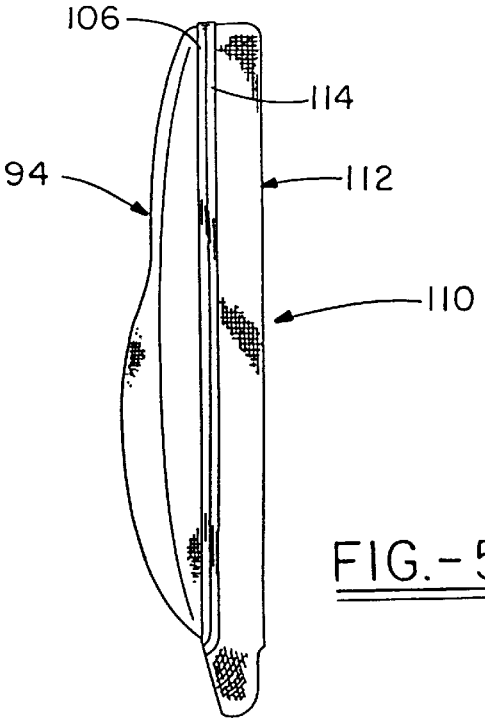
FIG. 5 is a side elevational view of a third embodiment of the bag housing assembly.

A third embodiment of the bag housing assembly is shown in FIG. 5 and is indicated at 110. Bag housing assembly 110 is generally similar to bag housing assembly 90 with the exception of the rear bag housing. Bag housing assembly 110 includes a rear bag housing 112 having a fabric panel 113 formed from the same or a similar fabric material as bag door 94, and a rigid support frame 114 attached to the periphery of panel 113 using any of the fastening methods discussed above. Support frame 114 provides a rigid support structure for the releasable attachment of frame member 106 of bag door 94 thereto.

Figure 6:
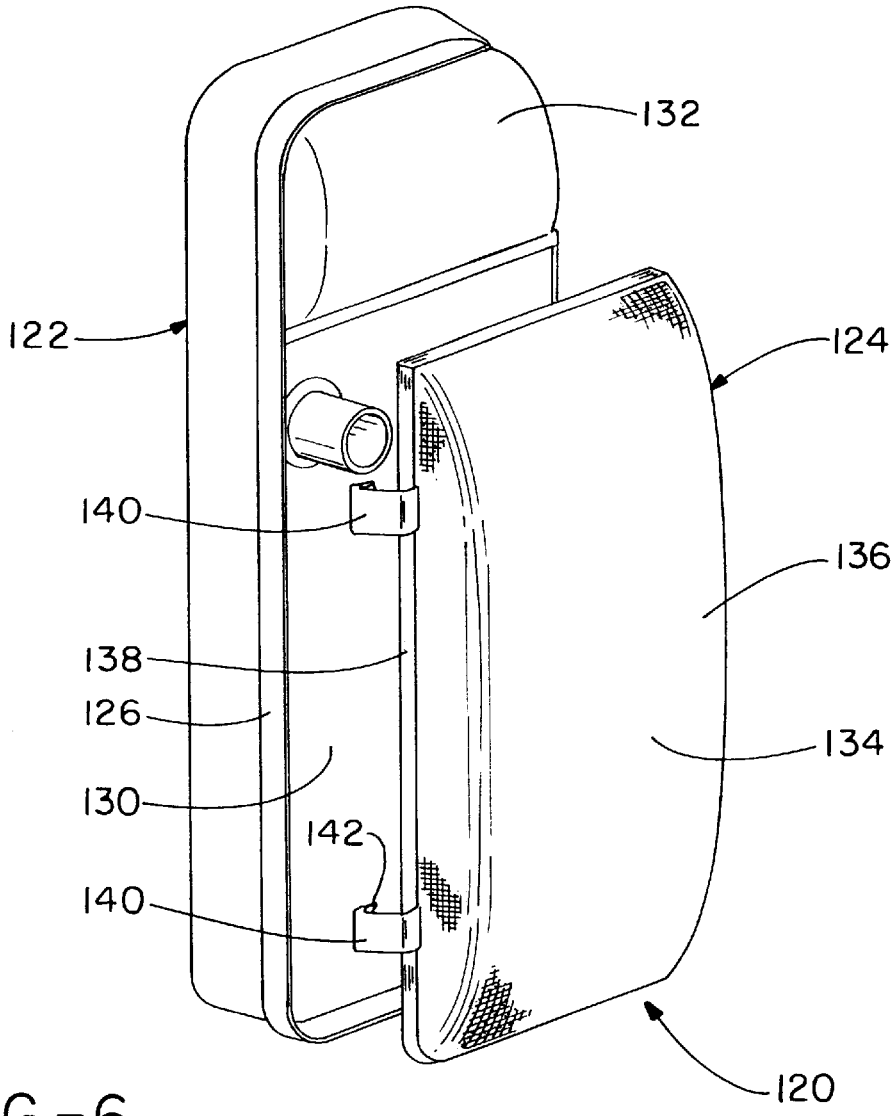
FIG. 6 is an exploded perspective view of a fourth embodiment of the bag housing assembly.
Figure 6A:
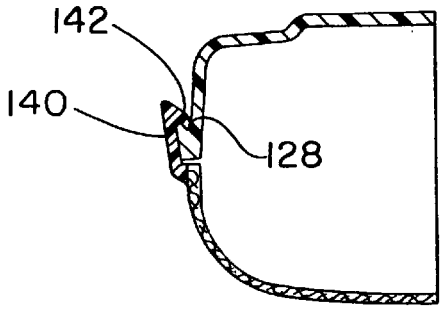
FIG. 6A is a fragmentary sectional view of the bag housing assembly of FIG. 6 showing the latching arrangement between the bag housing door and the rear bag housing.

A fourth embodiment of the bag housing assembly is shown in FIG. 6 and is indicated at 120. Bag housing assembly 120 includes a rear bag housing 122 and a bag door 124. Rear bag housing 122 is generally rectangular in shape and includes a frame support member 126. Frame support member 126 extends outwardly from the periphery of rear bag housing 122 and forms a generally V-shaped groove 128 (FIG. 6A). Rear bag housing 122 is formed with a bag cavity 130 for receiving filter bag 28, and an accessory tool storage compartment 132 for receiving various vacuum cleaner accessory tools. Rear bag housing 122 may be formed of either a rigid plastic material, in which case frame support member 126 is integral with rear bag housing 122, or rear bag housing 122 may be formed of a bi-component layers 50 and 52 in which case frame support member 126 is attached to rear bag housing 122 using any of the methods described above.

Bag door 124 includes a fabric panel 134 which has a curved outer surface 136, and a rigid peripheral frame member 138. Frame member 138 includes a plurality of integrally formed outwardly extending tabs 140 which have a barbed outer end 142. Barbed ends 142 of tabs 140 snap-fit within V-shaped groove 128 formed by frame support member 126 for releasably retaining bag door 124 to rear bag housing 122.

Figure 7A:
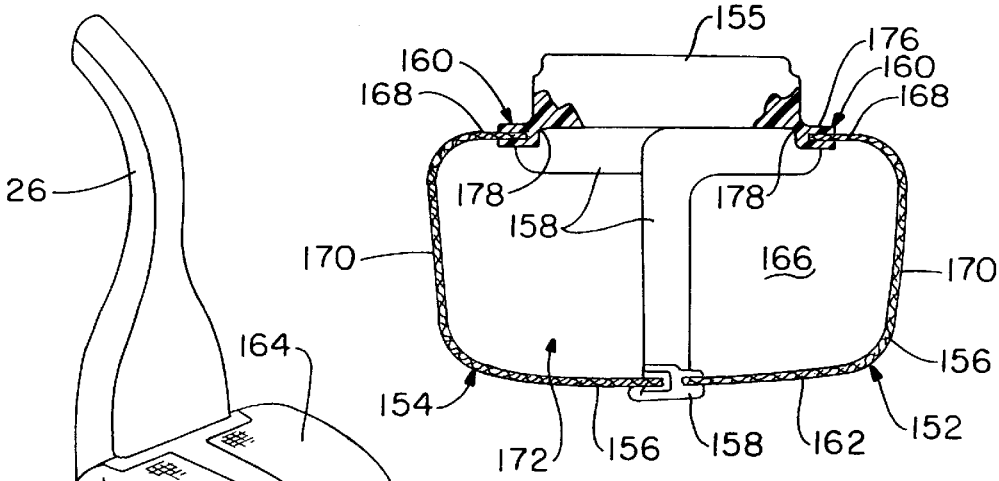
FIG. 7A is a sectional view of the bag housing assembly of FIG. 7 showing the bag housing assembly in a closed position.
Figure 7:
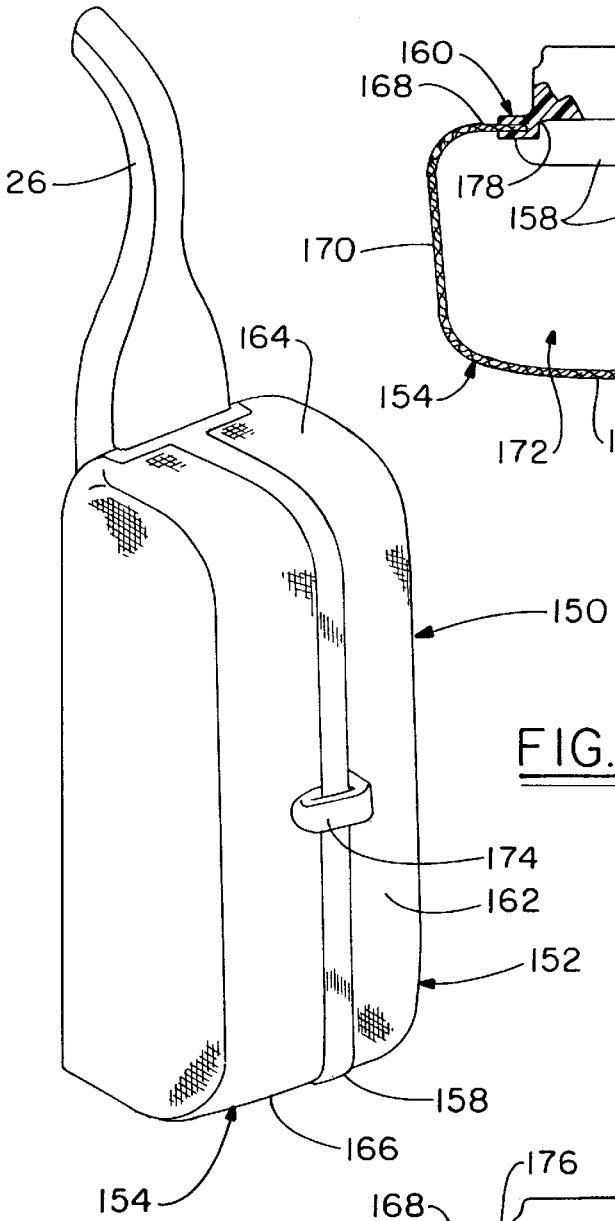
FIG. 7 is a perspective view of a fifth embodiment of the bag housing assembly.
Figure 7B:
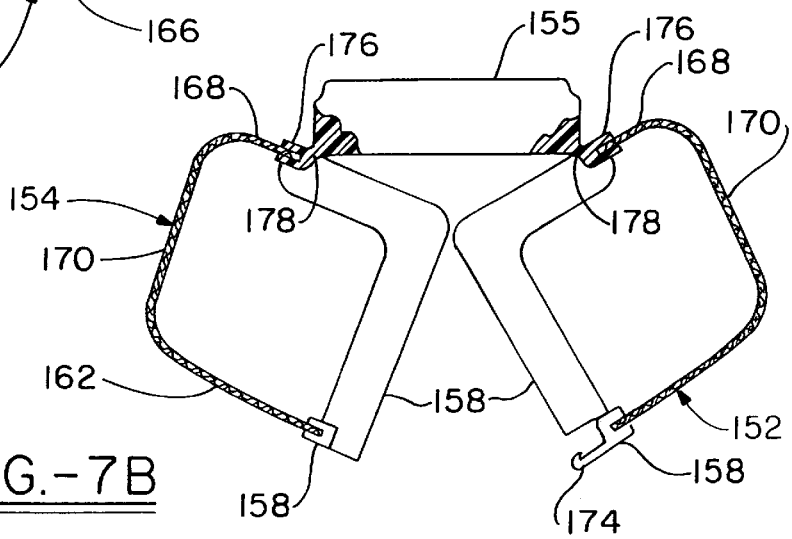
FIG. 7B is a sectional view similar to FIG. 7A showing the bag housing assembly in an open position.

A fifth embodiment of the bag housing assembly is shown in FIGS. 7–7B and is indicated at 150. Bag housing assembly 150 includes right and left bag doors 152 and 154, respectively, and a rear bag housing 155 which is formed by part of upper handle portion 26, Bag doors 152 and 154 are pivotally attached to opposed sides of rear bag housing 155 and are pivotable between the open position of FIG. 7B and the closed position of FIG. 7A. Each bag door 152 and 154 is formed with a fabric panel 156, a latching frame member 158 and a support frame member 160. Each fabric panel is formed with a front wall 162 which curves at the top and bottom thereof to form a top wall 164 and a bottom wall 166, respectively, a rear wall 168 and a side wall 170. Walls 162, 164, 166, 168 and 170 of each bag door 152 and 154 form approximately half of a rectangular bag cavity 172.

Latching frame member 158 and support frame member 160 are preferably formed of a rigid plastic material. Latching frame member 158 of right bag door 152 overlaps latching frame member 158 of left bag door 154 along the front, top and bottom walls (FIG. 7A), and includes a latching tab 174 which secures the bag doors in the closed position. Support frame member 160 attaches to the edge of rear wall 168 of each fabric panel 156 and includes a support portion 176 and a vertically extending living hinge 178. Support portion 176 fastens support frame member 160 to fabric panel 156 using any of the fastening methods described above. Living hinge 178 extends between support portion 176 and rear bag housing 155. Living hinge 178 is formed integrally with and of the same material as rear bag housing 155 and support portion 176, but is of a reduced thickness. The reduced thickness of living hinge 178 provides flexibility to the normally rigid plastic material which allows bag doors 152 and 154 to pivot between the open and closed positions.

A sixth embodiment of the bag housing assembly is shown in FIG. 8 and is indicated at 180. Bag housing assembly 180 includes a generally rectangular bag housing or base 182 and a generally rectangular bag door or lid 184, both of which are formed of a fabric material. Base 182 has a front wall 186, a rear wall 187, a bottom wall 188 and a pair of side walls 189. Walls 186–189 form a lower bag cavity 190 for receiving a lower portion of vacuum cleaner filter bag 28. Base 182 may be either permanently or releasably mounted to upper handle portion 26. Lid 184 includes a front wall 192, a rear wall 193, a top wall 194 and a pair of side walls 195. Walls 192–195 form an upper bag cavity 196 for receiving an upper portion of vacuum cleaner filter bag 28.

An angled lip 198 extends outwardly from walls 186, 187 and 189 of base 180 and is overlapped by a rigid plastic frame member 200 which extends outwardly from a bottom edge of walls 192, 193 and 195 of lid 184. Frame member 200 may be fastened to walls 192, 193 and 195 by any of the fastening methods described above. Lip 198 and frame member 200 may include a strip of a fastening tape, such as a hook and loop type of fastener, which secures lid 184 to base 182 to enclose the vacuum cleaner filter bag therein during use of vacuum cleaner 22.

A seventh embodiment of the bag housing assembly is shown in FIGS. 9 and 9A and is indicated at 210. Bag housing assembly 210 includes a rigid bottom base 212 mounted to a rear bag housing 213 formed by part of upper handle portion 26. Base 212 is fastened to and supports a curved fabric panel 214. Panel 214 is attached to rear bag housing 213 by a frame member 216 (FIG. 9A) which may be formed integrally with rear bag housing 213 or which may be fastened to the rear bag housing using screws, a snap-fit arrangement or any other type of suitable fastener. Panel 214 is fastened to frame member 216 using any of the fastening methods discussed above. Base 212, panel 214 and rear bag housing 213 form a bag cavity 218 having an open top end which provides access to filter bag 28. Bag cavity 218 is enclosed by a lid 220 which is pivotally mounted on rear bag housing 213 by a lug 222 which extends from the rear bag housing, and a pair of flanges 224 which extend from lid 202. Lug 222 extends between flanges 224 and is pivotally held therein by a pivot pin 226. Lid 220 may be formed of a dense material, such as metal or a thick plastic, whereby the weight of lid 220 retains bag housing assembly 210 in the closed position of FIG. 9, or may be formed of fabric and include some type of latching arrangement to retain the lid in the closed position.

Figure 10A:
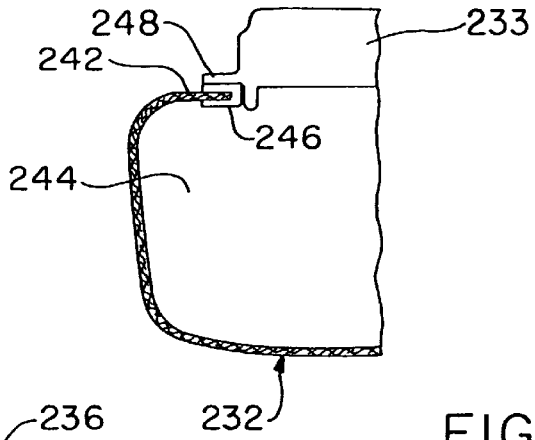
FIG. 10A is a fragmentary sectional view of the bag housing assembly of FIG. 10.
Figure 10:
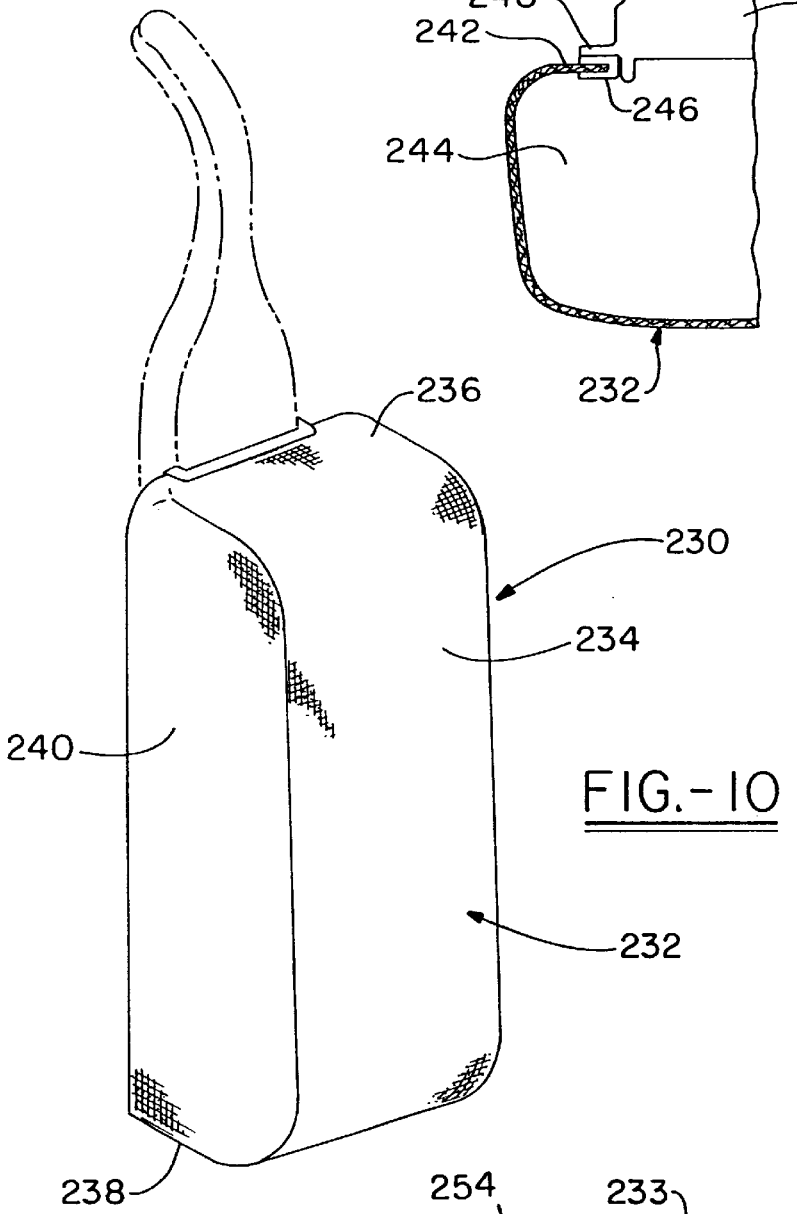
FIG. 10 is a perspective view of an eighth embodiment of the bag housing assembly.

An eighth embodiment of the bag housing assembly is shown in FIGS. 10 and 10A and is indicated at 230. Bag housing assembly 230 includes a fabric panel 232 and a rear bag housing 233 which is formed by part of upper handle portion 26. Fabric panel 232 is formed with a front wall 234, a top wall 236, a bottom wall 238, a pair of side walls 240 and a pair of rear wall portions 242 (FIG. 10A) which extend inwardly a short distance from side walls 240. Walls 234, 236, 238, 240 and rear wall portions 242, along with rear bag housing 233 form a bag cavity 244. A frame member 246 (FIG. 10A) is fastened to the edge of top wall 236, bottom wall 238 and rear wall portions 242. Preferably, frame member 246 is formed of metal and is clamped to the edge of fabric panel 232. A pair of magnetic strips 248 extend vertically along each side of rear bag housing 233 which attract metal frame member 246 to retain fabric panel 232 on the rear bag housing.

Figure 10B:
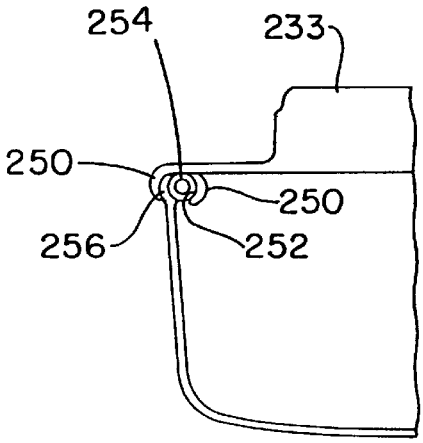
FIG. 10B is a fragmentary sectional view similar to FIG. 10A showing an alternate latching arrangement of the bag housing assembly of FIG. 10.

Alternatively, rear bag housing 233 maybe include a pair of outwardly extending curved arms 250 (FIG. 10B) which form with a channel 252 therebetween. A tubular seal 254 is positioned within channel 252. A frame member 256 is formed on the outer edge of side walls 240 which extends within channel 252 and is frictionally retained therein by seal 254. Frame member 256 may be formed of plastic or may be formed by compressing fabric panel 232 to create an outer edge which is sufficiently rigid to slide within channel 252 and be frictionally held therein by seal 254.

Figure 11:
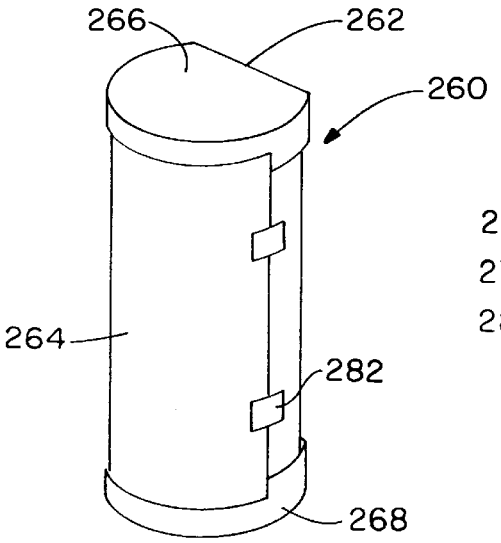
FIG. 11 is a perspective view of a ninth embodiment of the bag housing assembly.
Figure 11A:
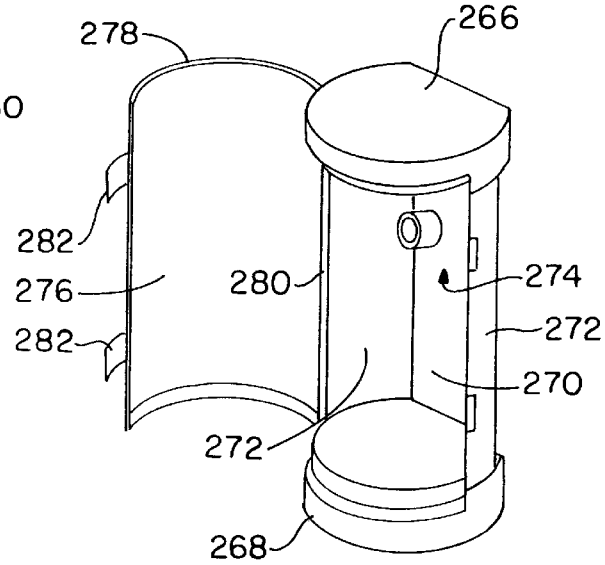
FIG. 11A is a perspective view showing the bag housing assembly of FIG. 11 in an open position.

A ninth embodiment of the bag housing assembly is shown in FIGS. 11 and 11A and is indicated at 260. Bag housing assembly 260 is generally cylindrical shaped and includes a rear bag housing 262 and a bag door 264. Rear bag housing 262 includes a top 266, a bottom or base 268, a flat rear wall 270 (FIG. 11A) and a pair of side wall portions 272. Top 266, bottom 268, rear wall 270 and side wall portions 272 are integrally formed as a one-piece plastic member to form a bag cavity 274. Bag door 264 encloses bag cavity 274 and includes a curved fabric panel 276 and a plastic frame member 278 attached to the periphery of fabric panel 276 by any of the fastening methods discussed above. Frame member 278 is connected to one of side wall portions 272 by a living hinge 280. Living hinge 280 is formed integrally with and of the same plastic material as frame member 278 and rear bag housing 262. Living hinge 280 is of a reduced thickness which provides sufficient flexibility to the plastic material to allow bag door 264 to pivot between the open position of FIG. 11A and the closed position of FIG. 11. Bag door 264 is held in the closed in the closed position by a pair of flaps 282 which releasably fasten to rear bag housing 262 and which are formed of a fastening tape, such as a hook and pile material.

Figure 11C:
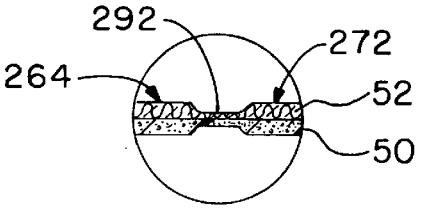
FIG. 11C is an enlarged sectional view of the encircled portion of FIG. 11B.
Figure 11B:
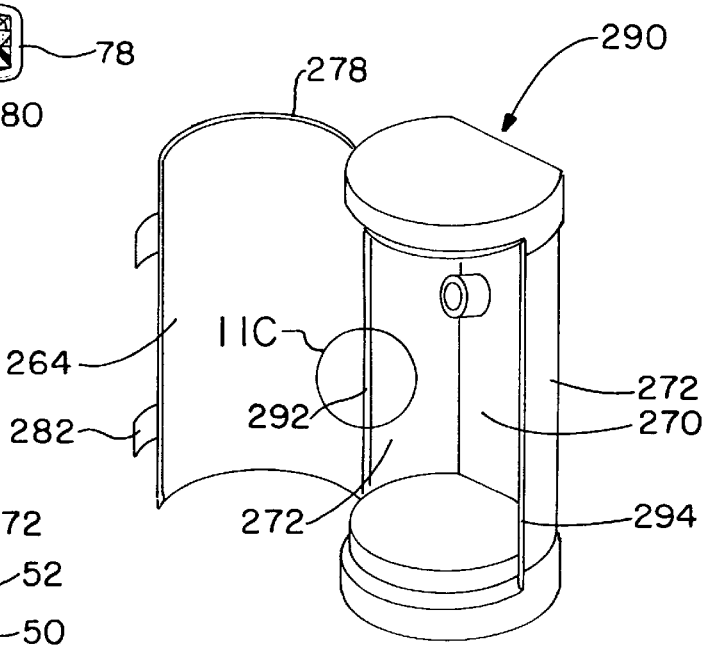
FIG. 11B is a perspective view showing an alternative hinge arrangement of the bag housing assembly of FIG. 11.

An alternative embodiment of bag housing assembly 260 is shown in FIG. 11B and is indicated at 290. Bag housing assembly 290 is generally similar to bag housing assembly 260 except that rear bag housing 262 and bag door 264 are formed as a one-piece fabric panel. A living hinge 292 is formed between the bag housing and bag door by compressing the fabric material to a reduced thickness (FIG. 11C) between the inner edge of bag door 264 and side wall portion 272 to which bag door 264 pivotally connects. This reduced thickness living hinge provides sufficient flexibility to the normally semi-rigid flexible material to allow bag door 264 to pivot between the open and closed positions. Frame member 278 of bag housing assembly 290 extends along the top, bottom and outer edge of bag door 264 with an additional support frame member 294 extending along the edge of the side wall portion opposite living hinge 292 to strength and provide support to the fabric panels.

It is understood that any of the alternate methods of attaching a fabric panel to a plastic frame member shown in FIGS. 12A–12G may be used with any of the embodiments of the vacuum cleaner bag housing assembly discussed above. It is further understood that any of the various latching arrangements used to attach the doors the rear bag housing discussed above may be used with any of the embodiments of the vacuum cleaner bag housing assembly of the present invention. Additonally, it is understood that the term "fabric" as used above may be any semi-rigid flexible fabric material, but is preferably bi-component polyester 50 which may or may not be covered with stretchable polyester layer 52.

Accordingly, the vacuum cleaner bag housing assembly of the present invention provides a rear bag housing which forms a bag cavity. The bag cavity houses a vacuum cleaner filter bag and is enclosed by a bag door. The bag door is at least partially formed of a semi-rigid flexible fabric material, such as a polyester and preferably a bi-component polyester, which is soft and deformable yet sufficiently rigid to retain a molded shape. The fabric material is non-scuffing so as not to damage furniture when contact is made therewith and is lightweight which reduces the total weight of the vacuum cleaner as compared to vacuum cleaners having solid plastic bag doors. Also, the fabric material provides additional layers of filtration to further filter the exhaust air from the filter bag. Additionally, the rigid plastic frame member which is fastened to the fabric panel, and preferably molded directly thereto, provides a support structure which facilitates the attachment of the bag door to the rear bag housing. The frame member provides easy access to the filter bag for the removal and replacement thereof and provides an aesthetically pleasing appearance to the vacuum cleaner.

Accordingly, the improved vacuum cleaner bag housing assembly is simplified, provides an effective, inexpensive, and efficient device which achieves all of the enumerated objectives. While there has been shown and described herein preferred embodiments of the present invention, it should be readily apparent to persons skilled in the art that numerous modifications may be made therein without departing from the true spirit and scope of the invention. Accordingly, it is intended by the appended claims to cover all modifications which come within the spirit and scope of the invention.

What is claimed is:

1. A vacuum cleaner bag housing assembly movable between an open position which provides access to a vacuum cleaner filter bag, and a closed position which encloses the vacuum cleaner filter bag, said bag housing assembly including:

a bag housing which forms a bag cavity for receiving the vacuum cleaner filter bag; a bag door attached to the bag housing which encloses the bag cavity, the bag door including a panel formed of a semi-rigid flexible material and having a periphery; and herein at least a portion of one of the bag housing and the bag door is formed of a semi-rigid flexible material which is permeable to air and sufficiently rigid to retain a molded shape, and the at least a portion of one of the bag housing and bag door formed of semi-rigid flexible material has a plastic frame member molded directly to the periphery of the panel.

2. The bag housing assembly defined in claim 1 in which both the bag housing and bag door are formed of the semi-rigid flexible material; in which both the bag housing and bag door include a frame member attached thereto; and in which the frame member of the bag housing attaches to the frame member of the bag door for placing the bag housing assembly in the closed position.

3. The bag housing assembly defined in claim 1, further including a latching arrangement on at least one of the bag door and bag housing for retaining the bag housing assembly in the closed position.

4. A vacuum cleaner bag housing assembly movable between an open position which provides access to a vacuum cleaner filter bag, and a closed position which encloses the vacuum cleaner filter bag, said bag housing assembly including: a bag housing which forms a bag cavity for receiving the vacuum cleaner filter bag; a bag door attached to the bag housing which encloses the bag cavity; and wherein at least a portion of one of the bag housing and bag door is formed of a semi-rigid flexible material which is permeable to air and sufficiently rigid to retain a molded shape, the at least one of the bag door and bag housing includes a latching arrangement for retaining the bag housing assembly in the closed position, the latching arrangement includes a pair of curved arms which extend outwardly from the bag housing to form a channel therebetween, and a tubular seal positioned within said channel, a peripheral edge of the bag door extending within said channel and being frictionally engaged by said seal to retain the bag housing assembly in the closed position.

5. A vacuum cleaner bag housing assembly movable between an open position which provides access to a vacuum cleaner filter bag, and a closed position which encloses the vacuum cleaner filter bag, said bag housing assembly including:

a bag housing which forms a bag cavity for receiving the vacuum cleaner filter bag, the bag housing being formed of the semi-rigid flexible material which is permeable to air and sufficiently rigid to retain a molded shape and is formed with an open top end; and a bag door enclosing said open top end to place the bag housing assembly in the closed position.

6. The bag housing assembly defined in claim 5 in which the bag door is hingedly attached to the bag housing, said bag door being pivotable towards and away from said bag housing for moving the bag housing assembly between the closed and open positions, respectively.

7. A vacuum cleaner bag housing assembly movable between an open position which provides access to a vacuum cleaner filter bag, and a closed position which encloses the vacuum cleaner filter bag, said bag housing assembly including:

a bag housing which forms a bag cavity for receiving the vacuum cleaner filter bag, the bag housing having a pair of bag doors which are hingedly attached to the bag housing which enclose the bag cavity, said pair of bag doors being pivotable towards and away from one another to move the bag housing assembly between the closed and open positions respectively; and wherein at least a portion of each bag door of the pair of bag doors is formed of a semi-rigid flexible material which is permeable to air and sufficiently rigid to retain a molded shape.

8. An improved vacuum cleaner bag housing assembly having a bag housing which forms a cavity for housing a vacuum cleaner filter bag, and a bag door which encloses the bag cavity, the improvement comprising: a first portion of the bag door being formed of a fabric material which is permeable to air and sufficiently rigid to retain a molded shape; and a second portion of the bag door being formed of a non-permeable material.

9. The improved vacuum cleaner bag housing assembly defined in claim 8 in which the fabric material is a bi-component polyester.

10. The improved vacuum cleaner bag housing assembly defined in claim 9 in which the bag door further includes a decorative layer of a stretchable polyester material which is attached to an outer surface of the bi-component polyester material.

11. An improved vacuum cleaner bag housing assembly having a bag housing which forms a cavity for housing a vacuum cleaner filter bag, and a bag door which encloses the bag cavity, the improvement comprising: a first portion of the bag door being formed of a semi-rigid flexible material which is permeable to air and sufficiently rigid to retain a molded shape; and a second portion of the bag door being formed of a non-permeable material, the second portion of the bag door being formed of a plastic material which is molded directly to a peripheral edge of the first portion of said bag door.

12. A vacuum cleaner bag housing assembly having a bag housing formed with a cavity, and a bag door attached to the bag housing for enclosing said cavity, said bag door including:

a panel formed of a semi-rigid flexible material which is permeable to air and sufficiently rigid to retain a molded shape;

a frame member fastened to the panel for facilitating the attachment of the bag door to the bag housing; and a fastener for fastening the frame member to the panel.

13. The vacuum cleaner bag housing assembly defined in claim 12 in which the frame member is formed of plastic.

14. The vacuum cleaner bag housing assembly defined in claim 13 wherein the bag door further comprises a periphery, said plastic frame member being injection molded directly to said periphery of the bag door.

15. The vacuum cleaner bag housing assembly defined in claim 12 in which the fastener includes an adhesive for gluing the frame member to the panel.

16. The vacuum cleaner bag housing assembly defined in claim 12 in which the fastener includes a plurality of posts which extend outwardly from the frame member, a plurality of holes formed in the panel for receiving said posts and a retaining member formed with a plurality of holes which receive said posts, said frame member and retaining member sandwich the panel to fasten said panel to the frame member.

17. The vacuum cleaner bag housing assembly defined in claim 16 in which the posts are splined for frictionally engaging the holes of the retaining member.

18. The vacuum cleaner bag housing assembly defined in claim 16 in which each post includes an enlarged head which snap-fits within the holes of the retaining member.

19. The vacuum cleaner bag housing assembly defined in claim 12 in which the fastener includes staples for stapling the panel to the frame member.

20. The vacuum cleaner bag housing assembly defined in claim 12 in which the fastener includes welding the panel to the frame member.

21. The vacuum cleaner bag housing assembly defined in claim 12 in which the fastener includes a thread for sewing the panel to the frame member.

* * * * *